US006968954B2

(12) United States Patent
Hsieh

(10) Patent No.: US 6,968,954 B2
(45) Date of Patent: Nov. 29, 2005

(54) PACKING DEVICE FOR PROVIDING CUSHION FEATURE

(75) Inventor: Pi Hsieh, Chung-Ho (TW)

(73) Assignee: Wan Jeou Pyng Plastics Industry Co., Ltd., Taipei Hsien (TW)

( * ) Notice: Subject to any disclaimer, the term of this patent is extended or adjusted under 35 U.S.C. 154(b) by 211 days.

(21) Appl. No.: 10/681,588

(22) Filed: Oct. 7, 2003

(65) Prior Publication Data

US 2005/0074585 A1 Apr. 7, 2005

(51) Int. Cl.[7] ..... B32B 1/02

(52) U.S. Cl. ..... 206/587; 206/586; 206/589; 206/592; 428/119; 428/35.7

(58) Field of Search ..... 206/586, 591, 206/592, 587, 589, 454; 229/406, 407; 428/119, 428/35.7

(56) References Cited

U.S. PATENT DOCUMENTS 6,142,304 A * 11/2000 Moren et al. ..... 206/587

* cited by examiner

*Primary Examiner*—Alexander S. Thomas

(57) ABSTRACT

A packing device made of thermo-formed plastic sheet includes a bottom plate having adjacent first recesses and each first recess has first flaps which are higher than a receiving plane of the first recess, and each first recess has a positioning portion in an inside thereof. A side plate being foldable along a folding line relative to the bottom plate has engaging portions which are engaged with the positioning portions. The side plate includes adjacent second recesses and each second recess has a plurality of second flaps which are higher than a receiving plane of the second recess. The side plate has receiving portions located opposite to the engaging portions. A top plate being foldable along a folding line relative to the side plate has protrusions which are engaged with the receiving portions when the top plate is folded the folding line toward the side plate. The top plate has third recesses and each of which has third flaps which are higher than a receiving plane of the third recess. The first flaps, the second flaps, and the third flaps are located on lines parallel with each other so as to form a plurality of spaces for receiving the shock sensitive items.

3 Claims, 7 Drawing Sheets

PACKING DEVICE FOR PROVIDING CUSHION FEATURE

FIELD OF THE INVENTION

The present invention relates to a packing device that is made of thermo-formed plastic sheet and that provides cushion feature so as to protect the electronic product packed in the packing device.

BACKGROUND OF THE INVENTION

It is one of the main concerns of protection of shock sensitive items such as electronic products during delivery. The products are packed by packing device such as polystyrene foam or paperboard. In order to reduce the risk of impact during transportation, the packing device has to be made thick enough so as to provide a cushion feature for the products. Nevertheless, the bulky packing device occupies too much space and the products are not easily to be positioned or fixed. If the packing device, such as paperboard, is made to be thin to save more space for the product, it has less ability of anti-shake feature and tends to be peeled off that affects the products to be packed. Besides, the conventional packing devices cannot be overlapped and this is inconvenient for the packers. Besides, for the electronic industry, one of the important factors of the cost of manufacturing is the time of assembly. A better-designed packing device reduces the time of packing. Generally, most of the electronic products are precious so that it is the main concerns to pack the maximum quantity of product within limited space and to deliver the product to its destinations. A conventional packing device 1 is shown in FIG. 1 and includes a top board 11 having separation plates 111 and a bottom board 12 having a bottom plate 124 and a plurality of side boards 121, 122, 123. Each of the side boards 121, 122, 123 has separation plates 125. The bottom plate 124 is first put in to a box 99 and the products 100 are put along the separation plates 125, and finally the top board 11 is covered on the side boards 121, 122, 123. The products 100 are not well positioned and could be hit with each other or hit by object from outside of the box 99.

Therefore, it is desired to have a proper packing device that provides well positioning and cushion features so as to provide protection to the products.

SUMMARY OF THE INVENTION

In accordance with an aspect of the present invention, there is provided a packing device made of thermo-formed plastic sheet for packing shock sensitive and the packing device includes a bottom plate having adjacent first recesses and each first recess has first flaps which are higher than a receiving plane of the first recess, and each first recess has a positioning portion in an inside thereof. A side plate being foldable along a folding line relative to the bottom plate has engaging portions that are engaged with the positioning portions. The side plate includes adjacent second recesses and each second recess has a plurality of second flaps that are higher than a receiving plane of the second recess. The side plate has receiving portions located opposite to the engaging portions. A top plate being foldable along a folding line relative to the side plate has protrusions which are engaged with the receiving portions when the top plate is folded the folding line toward the side plate. The top plate has third recesses and each of which has third flaps that are higher than a receiving plane of the third recess. The first flaps, the second flaps, and the third flaps are located on lines parallel with each other so as to form a plurality of spaces for receiving the shock sensitive items.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 2:
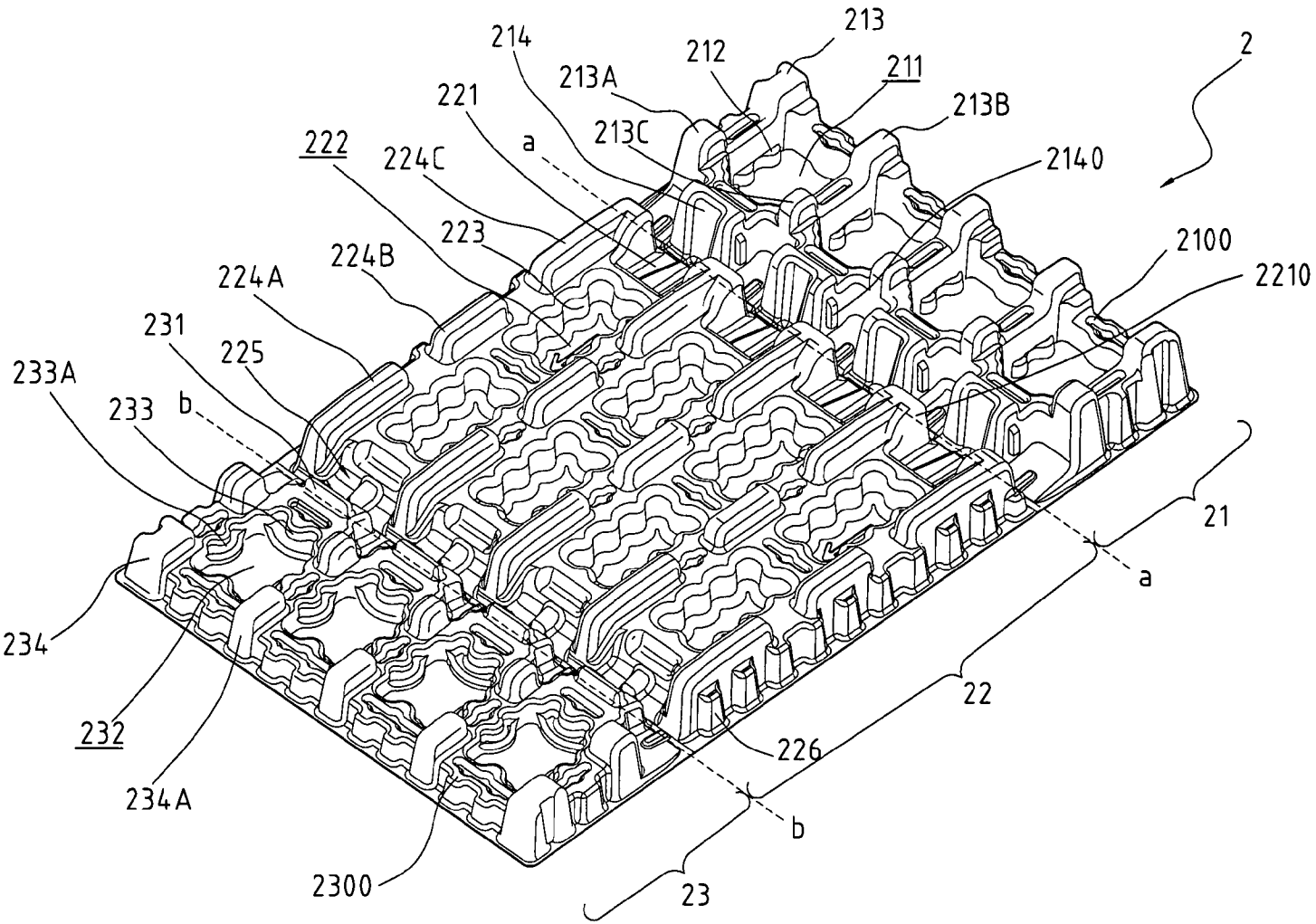
FIG. 2 is a perspective view to show the packing device of the present invention.
Figure 3:
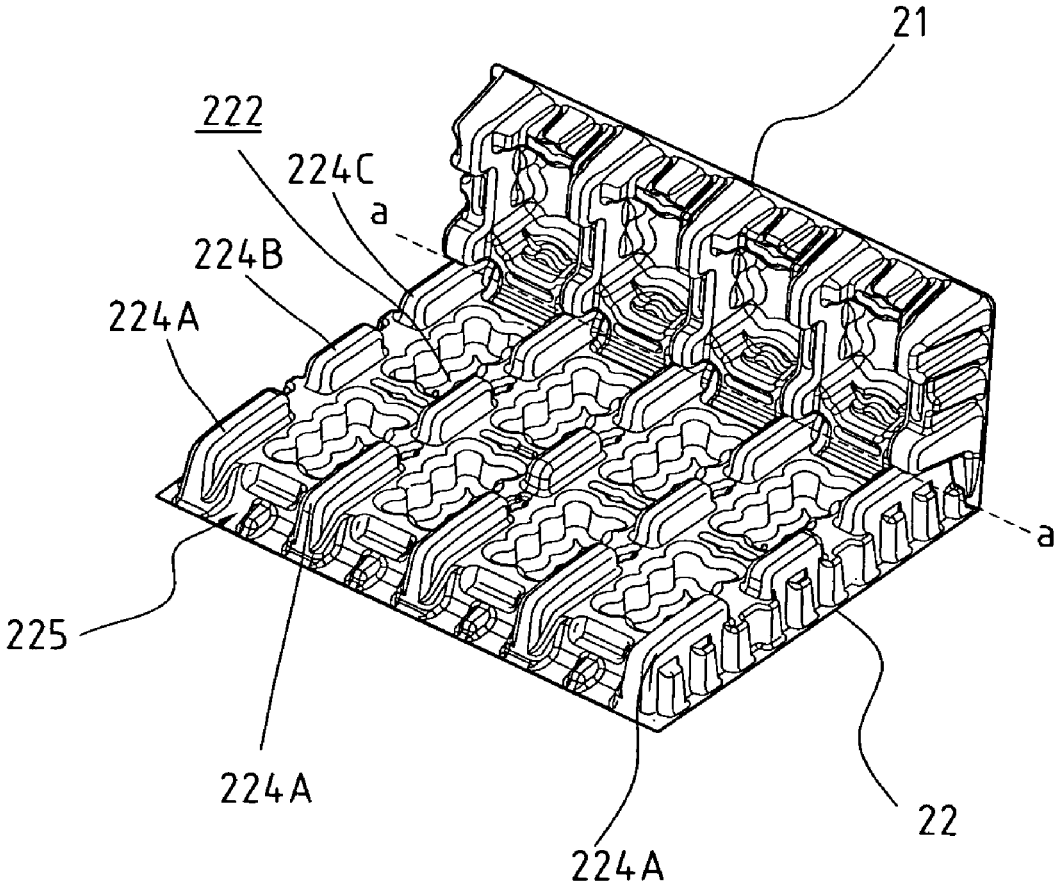
FIG. 3 is a perspective view to show the bottom plate is folded relative to the side board of the packing device of the present invention.
Figure 4:
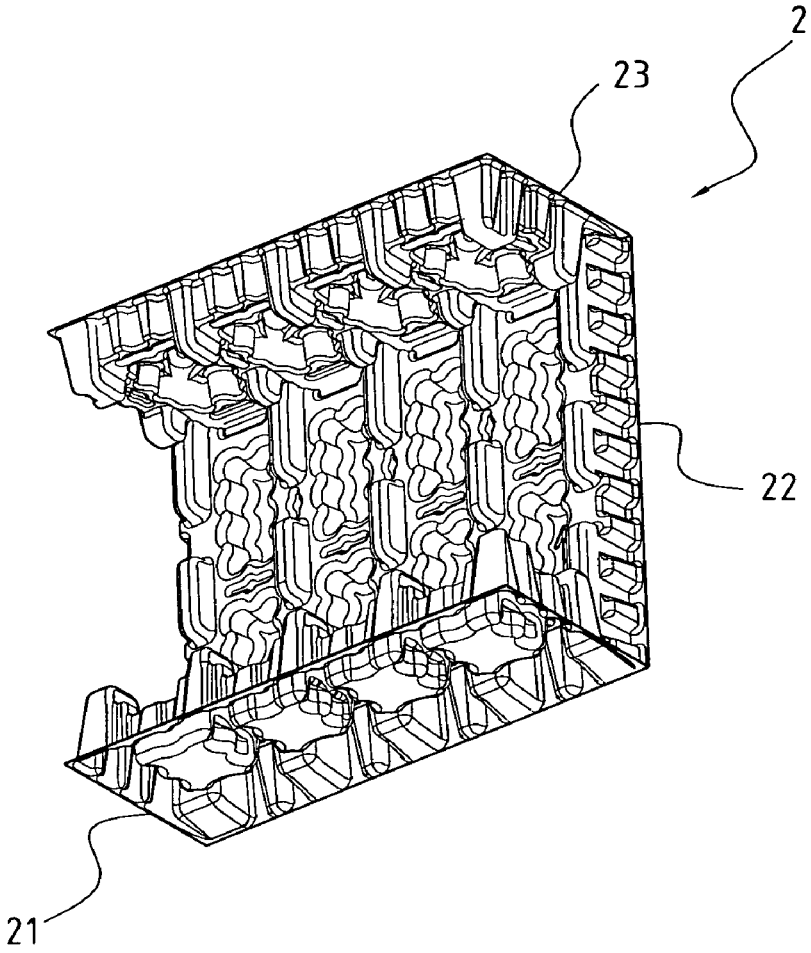
FIG. 4 is a perspective view to show the bottom plate and the top plate are respectively folded relative to the side board of the packing device of the present invention.
Figure 5:
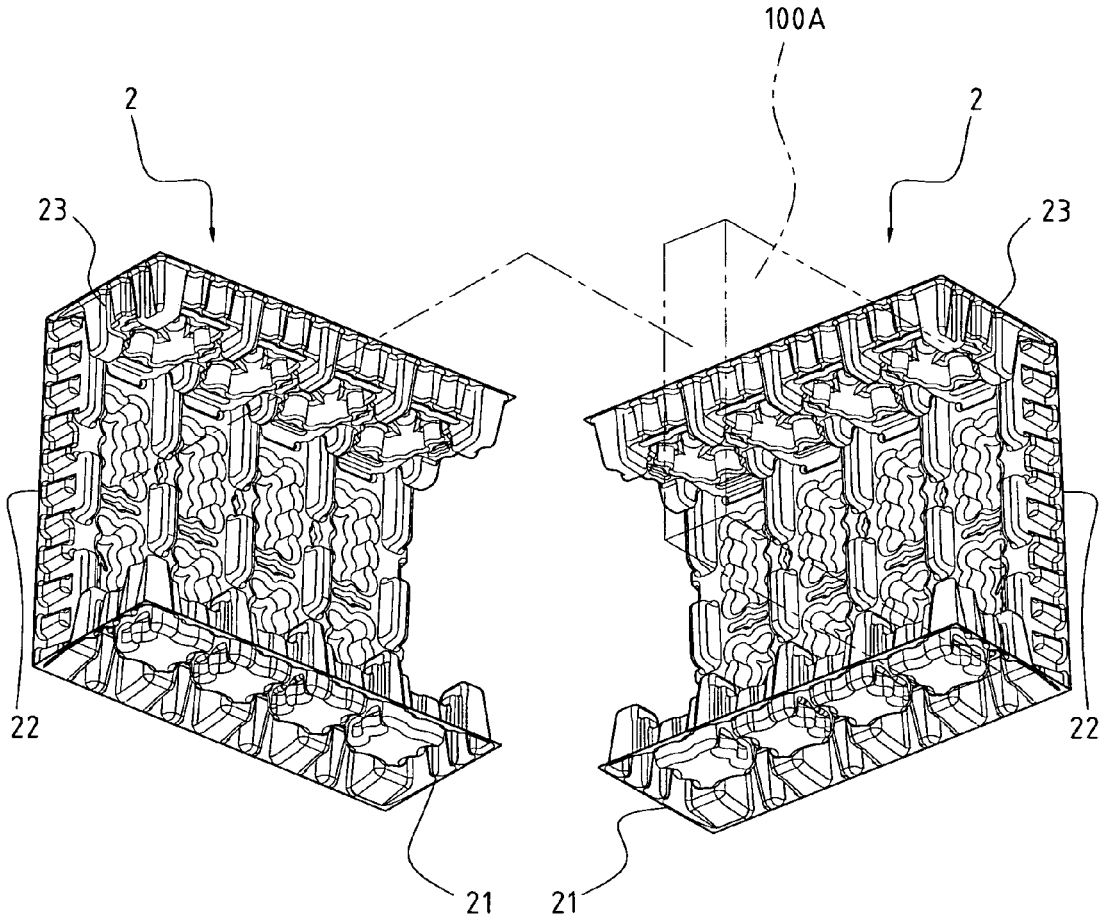
FIG. 5 shows two sets of the packing device to position the product.
Figure 6:
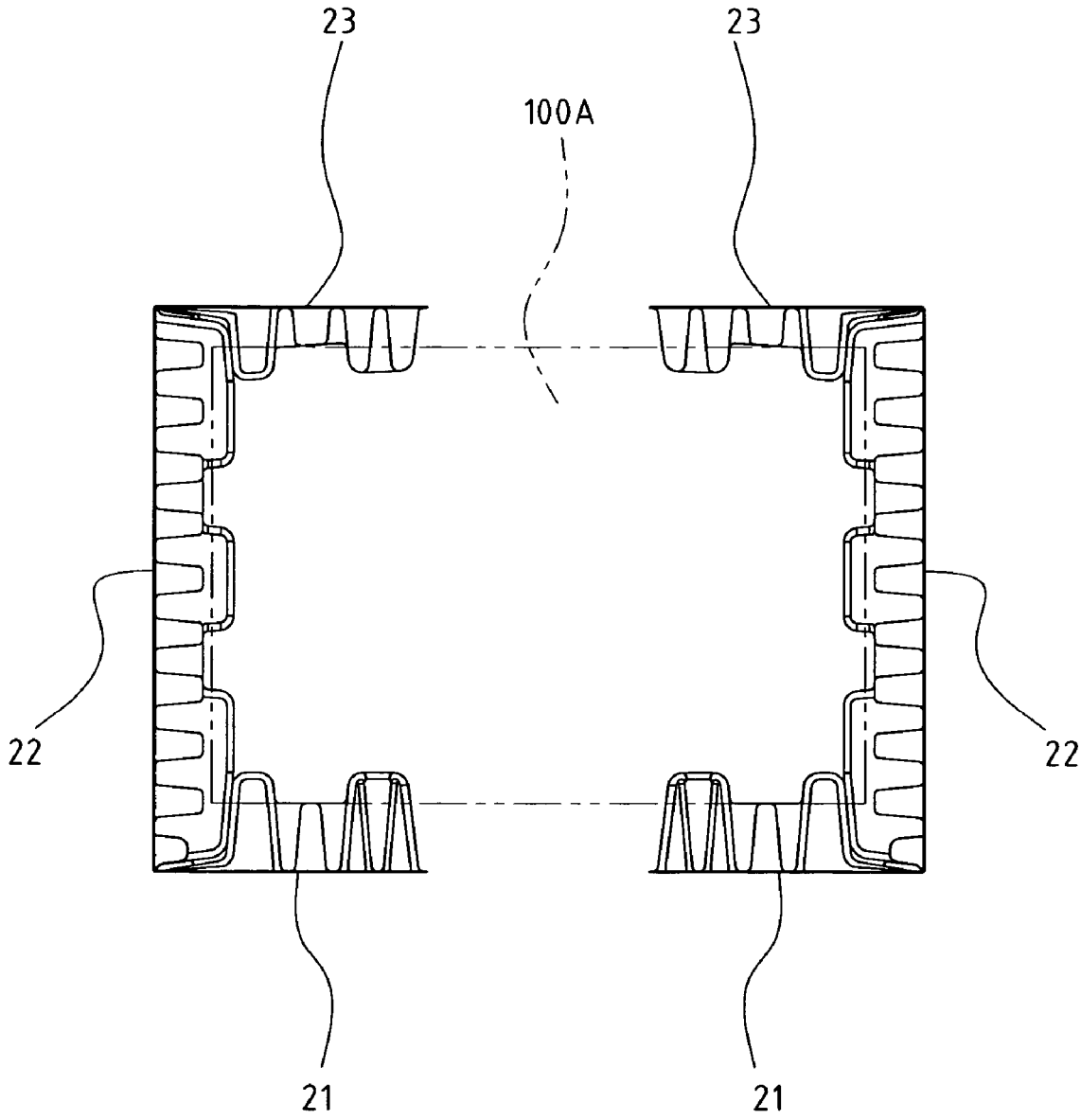
FIG. 6 shows a side view of the product being clamped by the two sets of packing device.

Referring to the drawings and in particular to FIG. 2, a packing device is made of thermo-formed plastic sheet so as to protect shock sensitive items 100A as shown in FIGS. 5 and 6. The packing device 2 includes a bottom plate 21, a side plate 22 and a top plate 23. The side plate 22 can be folded along line a—a toward the bottom plate 21, and the top plate 23 can be folded along line b—b toward the side plate 22 as shown in FIG. 3.

The bottom plate 21 includes several adjacent first recesses 211 and each of which has a stepped wave-shaped surface 212 so as to provide cushion feature. Each of the first recesses 211 has a plurality of first flaps 213, 213A which are higher than the receiving plane of the first recess 211 as shown in FIG. 6 so that the shock sensitive items 100A can be protected by the first flaps 213, 213A from slipping or dropping from the packing device.

Figure 7:
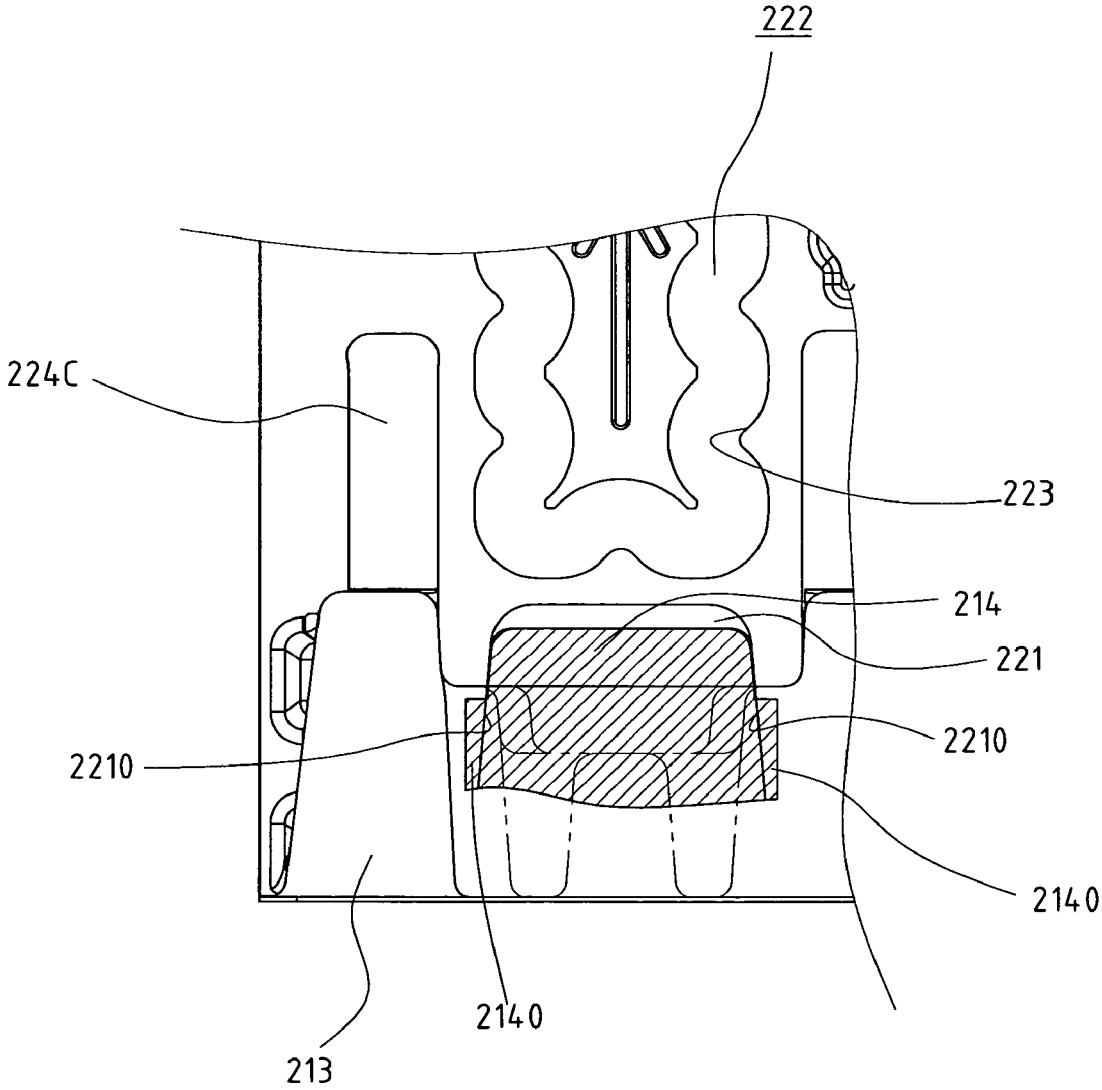
FIG. 7 shows the engagement between the bottom plate and the side plate of the packing device of the present invention.

Each of the first recesses 211 has a plurality of adjacent positioning portions 214 on an inside thereof and the side plate 22 has a plurality of engaging portions 221 which are located corresponding to the positioning portions 214 so that the side plate 22 is engaged with the positioning portions 214 of the bottom plate 21. There are several second flaps 224C located beside the folding line a—a and engaging ports 2210 are located at two sides of an end of each second flap 224C. The engaging ports 2210 are engaged with the positioning portions 214. Preferably, the positioning portion 214 includes a protrusion 2140 so as to be securely engaged with the engaging portion 221. FIG. 7 shows the protrusion 2140 is securely engaged with the engaging ports 2210 of the engaging portion 221.

The side plate 22 includes adjacent second recesses 222 and each second recess 222 includes a stepped wave-shaped inside 223. Preferably, some of the second recesses 222 have an arrow mark which assists the packers to identify the direction of folding. The side plate 22 includes a plurality of second flaps 224A, 224B, 224C which are higher than the receiving plane of the second recess 222.

The side plate 22 has receiving portions 225 located opposite to the engaging portions 221, and the top plate 23 has a plurality of protrusions 231 which are engaged with the receiving portions 225 when the top plate 23 is folded along the line b—b.

The top plate 23 has a plurality of third recesses 232 and each of which has stepped wave-shaped insides 233, 233A. Each of the third recesses 232 has a plurality of third flaps 234, 234A that are higher than the receiving plane of each third recess 232 as shown in FIG. 5, so that the shock sensitive items can be positioned by the third flaps 234, 234A when being placed in the third recess 232.

As shown in FIG. 5, the first flaps 213, 213A, the second flaps 224A, 224B, 224C, and the third flaps 234, 234A are located on lines parallel with each other so as to form a plurality of spaces for receiving the shock sensitive items 100A. Preferably, there are different marks on the first recesses 211, the second recesses 222 and the third recesses 232, such as different shapes of shallow recesses to assist the packers to identify the folding directions.

Figure 1:
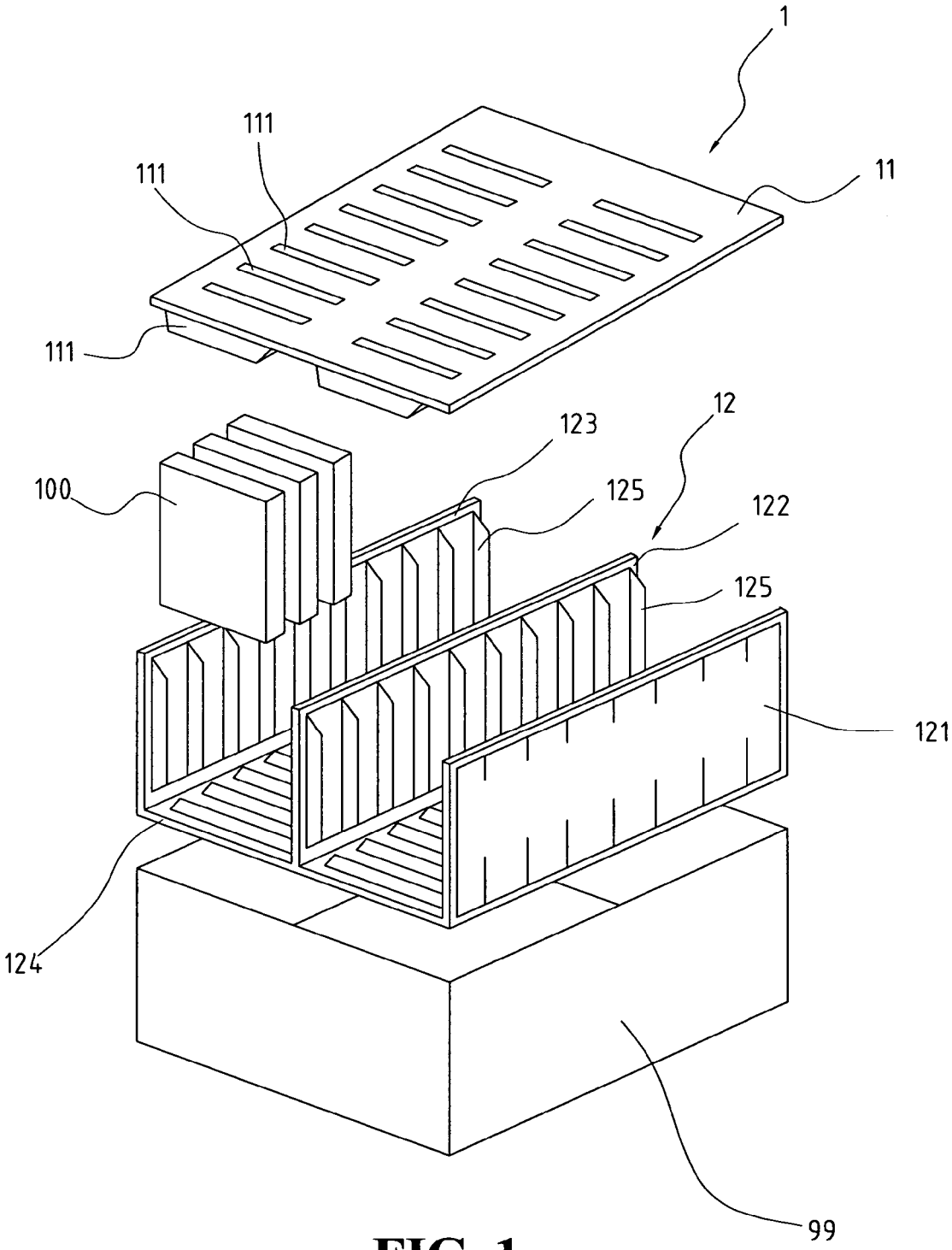
FIG. 1 (PRIOR ART)
FIG. 1 is an exploded view of a conventional packing device.

Referring to FIGS. 5 and 6, when the packers fold the packing device 2 in sequence order, two packing devices 2 made of thermo-formed plastic sheet are used to accommodate multiple products 100A. The packing devices 2 put in the box 99 as shown in FIG. 1 and then put the products 100A in the box 99. Preferably, as shown in FIG. 6, there are cushion blocks 226 on the outside of the side plate 22 and axes of the cushion blocks 226 are perpendicular to the axes of the second flaps 224A, 224B and 224C such that the packing device 2 has reinforcement of anti-shake feature.

The packing device can be made by single thermo-formed vacuum forming plastic sheet and so that it is convenient to be mass production so as to reduce the cost of manufacturing. Besides, because the material HDPE has better stiffness, flexibility and memory features so that it provides good cushion feature. For the foldable packing devices 2, they can be used repeatedly and has better anti-shake feature. The packing device can be arranged as U-shaped, wherein the L-shaped portions can be engaged at right angle which makes the electronic product easy to be put therein, and then covered with the other side to form the U-shaped packing device. For the packers, it is easily to finish the packing processes. This saves a lot of packing space and increases the quantity of the products.

While we have shown and described the embodiment in accordance with the present invention, it should be clear to those skilled in the art that further embodiments may be made without departing from the scope of the present invention.

What is claimed is:

1. A packing device made of thermo-formed plastic sheet for packing shock sensitive items, comprising:

a bottom plate having a plurality of adjacent first recesses and each first recess having a stepped wave-shaped inside, each first recess having a plurality of first flaps which are higher than a receiving plane of the first recess, each first recess having a positioning portion in an inside thereof;

a side plate being foldable along a folding line relative to the bottom plate and having engaging portions which are located corresponding to the positioning portions and engaged with the positioning portions, the side plate including adjacent second recesses and each second recess including a stepped wave-shaped inside, the side plate including a plurality of second flaps which are higher than a receiving plane of the second recess, the side plate having receiving portions located opposite to the engaging portions;

a top plate being foldable along a folding line relative to the side plate and having a plurality of protrusions which are engaged with the receiving portions when the top plate is folded the folding line toward the side plate, the top plate having a plurality of third recesses and each of which has stepped wave-shaped insides, each of the third recesses having a plurality of third flaps which are higher than a receiving plane of the third recess and the first flaps, the second flaps, and the third flaps being located on lines parallel with each other so as to form a plurality of spaces for receiving the shock sensitive items.

2. The packing device as claimed in claim 1, wherein each of the positioning portions has a protrusion so as to be engaged with the engaging portion.

3. The packing device as claimed in claim 1 further comprising cushion blocks on an outside of the side plate and axes of the cushion blocks being perpendicular to axes of the second flaps.

* * * * *